US005441257A

United States Patent [19]

Sheaffer

[11] Patent Number: 5,441,257

[45] Date of Patent: Aug. 15, 1995

[54] GOLF COURSE DISTANCE MARKER

[76] Inventor: Roger M. Sheaffer, 1155 Hidalgo, Laramie, Wyo. 82070

[21] Appl. No.: 329,434

[22] Filed: Oct. 26, 1994

[51] Int. Cl.[6] ..... A63B 57/00; G09F 7/22

[52] U.S. Cl. ..... 273/32 R; 116/209

[58] Field of Search ..... 273/32 R, 32 H, 176 A; 40/608; 52/103; 116/209; 404/10, 11

[56] References Cited

U.S. PATENT DOCUMENTS

| | | | |
|---|---|---|---|
| 1,939,968 | 12/1933 | Frei | 40/608 X |
| 3,279,133 | 10/1966 | De Korte | 52/103 |
| 3,371,647 | 3/1968 | Shopbell | 116/209 |
| 4,108,439 | 8/1978 | McGuire | 273/176 R |
| 4,240,766 | 12/1980 | Smith | 404/10 |
| 4,343,567 | 8/1982 | Sarver | 404/10 |
| 4,489,669 | 12/1984 | Carman | 273/32 R X |
| 4,522,530 | 6/1985 | Arthur | 404/10 |
| 4,649,678 | 3/1987 | Lamson | 52/103 |
| 4,862,823 | 9/1989 | Hughes | 116/209 |
| 5,040,478 | 8/1991 | Hughes | 116/209 |
| 5,072,940 | 12/1991 | Bailey | 273/176 A |
| 5,114,149 | 5/1992 | Bailey | 273/176 A |
| 5,186,119 | 2/1993 | Hlavin | 116/209 X |
| 5,205,236 | 4/1993 | Hughes | 116/209 X |
| 5,207,175 | 5/1993 | Andonian | 116/209 |
| 5,215,033 | 6/1993 | Gipp et al. | 116/209 |
| 5,230,297 | 7/1993 | Lakatos | 116/209 |
| 5,236,166 | 8/1993 | Darling | 248/519 |
| 5,356,134 | 10/1994 | DeMatteo | 273/32 R |
| 5,357,897 | 10/1994 | Bailey | 116/209 |

*Primary Examiner*—William H. Grieb
*Attorney, Agent, or Firm*—Dean P. Edmundson

[57] ABSTRACT

A distance marker system for mounting in a golf course fairway. The system includes a generally flat plate anchored in the ground and an upstanding cylindrical marker secured in a recessed cavity in the plate. When a reel-type mower encounters the marker from any direction, the marker is pushed away from its normal vertical position to a generally-horizontal position against the top of the plate. After the mower passes over the marker, the marker springs back to its normal vertical position again, without damage to the marker.

16 Claims, 2 Drawing Sheets

GOLF COURSE DISTANCE MARKER

FIELD OF THE INVENTION

This invention relates to golf course distance markers. More particularly, this invention relates to markers for placement on a golf course fairway to designate or identify the distance from the marker to the green.

BACKGROUND OF THE INVENTION

Golfers are particularly interested in knowing the distance from their ball to the green on a fairway. This information not only assists a golfer in selecting the proper club for the next shot but it also informs a golfer of the distance he or she achieved on the previous shot.

Typical distance markers used on golf course fairways include stakes placed in the rough on the sides of the fairway. Stakes are not always readily visible. Some courses use a flat disk in the fairway which is flush with the ground, but these disks are not very visible unless a golfer is very close to them.

U.S. Pat. No. 5,072,940 describes a golf course distance marker for mounting in the ground in a fairway. The marker includes a flat strip which can be deflected forwardly or rearwardly against the ground when a fairway mower passes over it. The flat strip has an enlarged anchor (e.g., concrete) at its lower end which is buried in the ground. The upper end of the thin flat strip extends above the ground and indicates the distance from the marker to the green. However, a severe limitation or disadvantage of such marker strip is that it can only be deflected in a direction perpendicular to the flat face of the strip, i.e., the strip can only be deflected downwardly when a mower approaches the marker strip perpendicular to one of the large flat faces of the strip. If a mower encounters the flat strip from any other angle, the strip would be broken off or mangled.

U.S. Pat. No. 5,114,149 describes a golf course distance marker for mounting in a fairway. The marker includes a flat strip which is mounted in a plastic tube. The lower end of the strip is connected to the lower end of the tube by means of a bolt passing through the strip and the tube. The strip includes an enlarged hole for the bolt so that the strip can be rotated about 90° in each direction relative to the bolt.

Although the presence of the enlarged hole in the flat strip may allow the strip a certain degree of rotational movement relative to the bolt, such feature does not enable the strip to completely rotate relative to the anchor. Furthermore, dirt and debris can easily enter into the tube in which the flat strip is anchored, because the top end of the tube is open. As dirt and debris build up in the tube, this will severely restrict or prevent the flat marker strip from being able to rotate relative to the mounting bolt. As a result, when a mower encounters the marker strip at an angle which is not perpendicular to the large flat surfaces of the strip, the strip may break or become damaged by the mower. Furthermore, it appears that it would be necessary to remove the anchoring tube from the ground in order to loosen the bolt and install a new marker strip whenever the original strip becomes broken or damaged. Also, repeated flexing of the flat metal or plastic strip can lead to fatigue and eventual breaking.

U.S. Pat. No. 4,522,530 describes a resilient plastic post which is used as a roadway marking post. The post consists of an outer resilient tube and an inner resilient tube. The post is intended to bend when struck by a motor vehicle. Such post would not be suitable for use as a golf course distance marker because it still extends above the ground a certain amount even when it is struck by a vehicle. A mower could still cause damage to the post even though the post deflects when it is struck.

U.S. Pat. No. 3,279,133 describes a boundary marker which comprises a rigid stake or post whose lower end is connected to an anchor in the ground by means of a coiled spring. Such marker is not intended to lie flat against the ground when it is struck. Consequently, a mower could become damaged by attempting to pass over the marker.

U.S. Pat. No. 5,207,175 describes a marker post which includes a lower end which is connected to an anchor in the ground by means of a coiled spring. Although the post can be flexed when impacted, the post would still extend above the ground where it could damage a mower passing over it.

U.S. Pat. No. 4,343,567 describes a roadway marking post comprising a flexible plastic tube which is connected to an anchor tube in the ground. This post would not be suitable for use as a golf course distance marker because it would still extend above the ground a certain amount when struck by a vehicle such as a mower. This could lead to damage to the mower.

U.S. Pat. No. 4,649,678 describes a marker post system for a golf course. The marker post is rigid and is removable from the ground, e.g., to enable a mower to pass over the anchor plate. The post does not flex or deflect.

U.S. Pat. No. 4,240,766 describes a moveable device which is plastic post fastened to a rigid conical base. The base includes an anchoring extension for insertion into a hole in the ground. Such a post would not be suitable for a fairway distance marker in the present invention.

U.S. Pat. No. 5,236,166 describes a base support for a flag. The support can be attached to a sprinkler unit on a golf course to prevent operators of heavy equipment from hitting or running over the sprinkler unit. After the golf course construction is complete, the flag holder insert is removed and replaced with a yardage marker.

U.S. Pat. No. 5,205,236 describes an a impact resistant marker for highway marking. A post is connected to a base by means of a flexible element. The post is not designed or intended to lie flat against the ground when passed over by a mower, for example.

U.S. Pat. No. 1,939,968 describes a flexible post for supporting barriers, sign posts, etc. The post includes a resilient tubular element reinforced with a coiled spring. A concrete anchor is placed in the ground and a cable extends through the length of the tubular element to the anchor. Although this post will deflect when struck, it was not designed or intended for use as a fairway distance marker.

There has not heretofore been provided a distance marker system for use in a golf course fairway which has the features and advantages provided by the present invention.

SUMMARY OF THE PRESENT INVENTION

In accordance with the present invention there is provided a distance marker system for mounting in a golf course fairway to provide visible yardage markers on the fairways. In a preferred embodiment the marker system comprises a marker mounted in the fairway at a given distance from the green, and the marker preferably comprises:

(a) a plate member having a central portion including a recessed cavity;

(b) an upstanding cylindrical marker member having upper and lower ends; wherein the lower end is secured in the cavity, and wherein the upper end extends above the plate member at least about six inches; wherein the marker member can be deflected in any direction away from an upstanding position to another position where the marker member lies against the plate member; and wherein the marker member is sufficiently resilient to return to the upstanding position; and (c) anchor means secured to the plate member for anchoring the plate member to the ground in the fairway.

The marker system of the invention is a convenience to the golfer who has become more sophisticated and demands that he knows the distance to the green before playing the next shot. Also, use of the marking system speeds up play by giving the golfer readily-identifiable distance information so that he can play his next shot without hesitation. By speeding up play on the course, more golfers can use the course on a given day. This also results in more revenue for the golf course.

Because the cylindrical marker is resiliently mounted and can be deflected in any desired direction, the angle at which a mower encounters the marker is irrelevant. The marker is adapted to deflect when impacted by a mower and lie flat against the plate so that a mower can pass directly over the marker and the plate without damage to either the mower or the marker.

Other advantages of the marking system of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
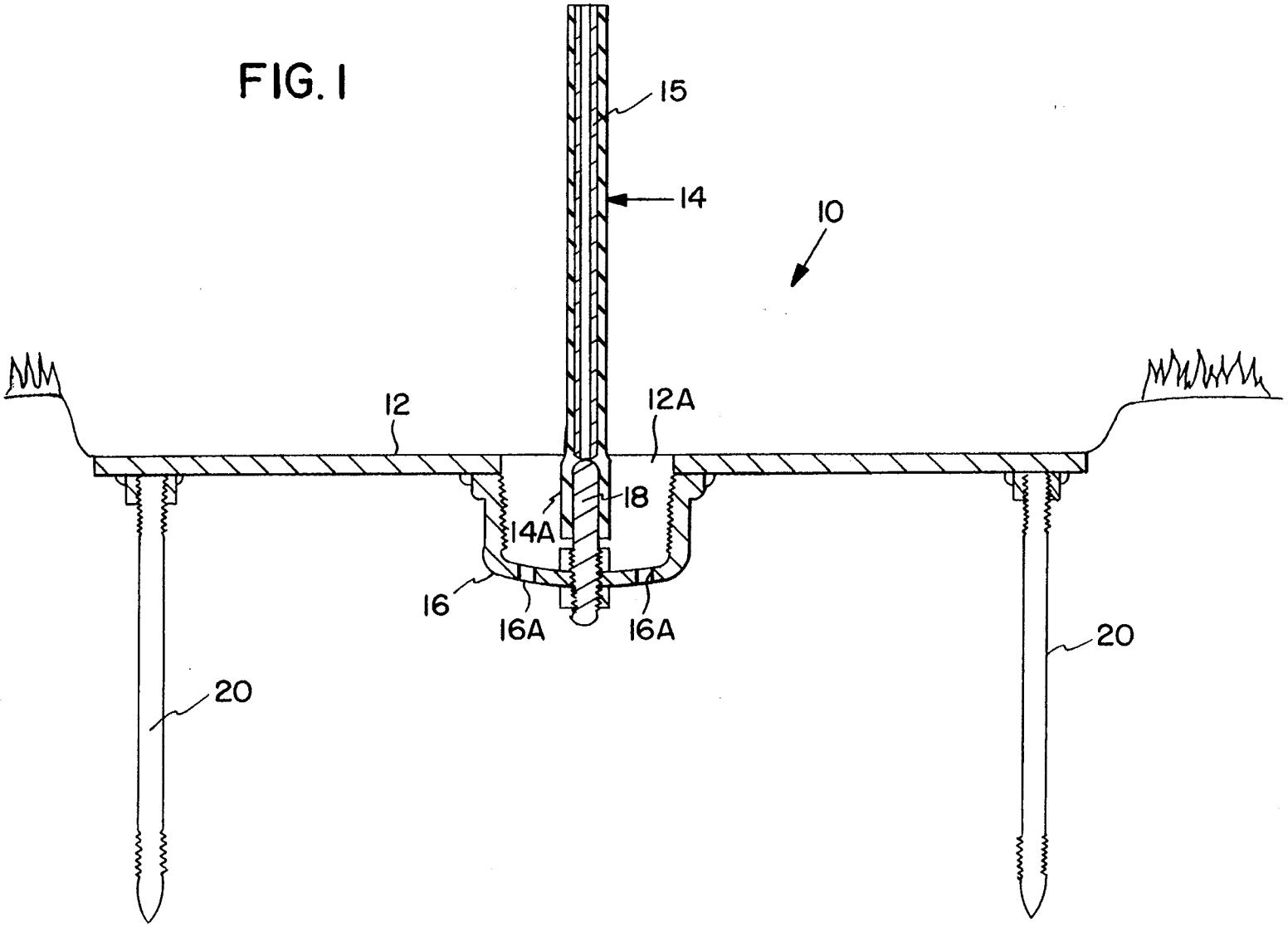
FIG. 1 is a cross-section view of one embodiment of marker system of the invention.
Figure 2:
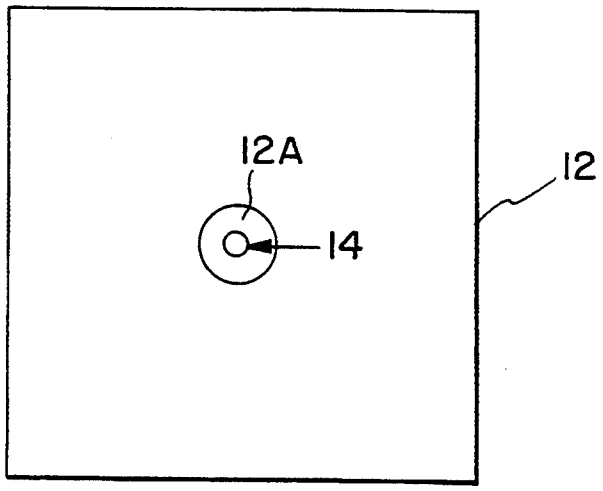
FIG. 2 is a top view of the marker system shown in FIG. 1.

In the drawings there is shown a preferred embodiment of marker system 10 of the invention comprising a plate member 12 and a cylindrical marker member 14 mounted at its base to the central portion of the plate. Preferably there is a cavity 16 extending downwardly from the opening 12A in plate 12.

A rigid mounting peg 18 extends upwardly from cavity 16 to a point flush with or slightly below the top surface of the plate. The cylindrical marker 14 comprises a rubber or elastomeric tube whose lower end 14A frictionally engages the peg 18 and retains the marker on the peg. The peg 18 preferably has a height of about 1.25 inches. This provides an adequate length for mounting the lower end 14A of the marker tube.

Preferably the bottom of the cavity includes one or more drain holes 16A to allow water or other debris to drain out of the cavity. The width and depth of the cavity may vary, as desired. Generally, a diameter of about two inches and a depth of about two inches is adequate. This diameter is sufficient to enable a person to slide the lower end of the rubber tube onto the peg with his fingers.

For purposes of the invention, any suitable cavity bracket or framework for supporting the peg 18 in a rigid and secure manner may be used. Such means for supporting the peg are considered equivalent for purposes of this invention. It is important that the upper end of the peg not extend above the top surface of the plate so that the peg is not damaged (and so that the peg does not damage the mower, golf carts, etc. which pass over the plate).

The cylindrical marker 14 extends above the top surface of the plate at least about six inches so that a conventional reel mower used on golf course fairways cannot grasp the marker when the mower passes over it. The typical reel mower has a diameter of about eight inches, and the center of the reel is about four inches above the ground. Thus, when the center of the reel encounters the marker, the reel pushes the marker away from the mower and forces it to lie flat against the plate as the mower passes over the marker and the plate.

A rigid or inflexible rod 15 is contained within the resilient, flexible elastomeric tube 14. The base of the rod 15 rests upon or in close proximity to the upper end of the peg 18. The lower end 14A of tube 14 frictionally engages the peg 18 and maintains the marker in a normally upright position. Yet, when a mower or other vehicle impacts the marker, the marker is able to be pushed flat against the upper surface of the plate without damaging the marker. Then the marker springs back to its original vertical position when the mower is clear of the marker.

Preferably the marker 14 and the plate 12 are color coded such that a given plate and associated marker are of the same color. A different color is used for each different distance between the marker and the green. For example, a red plate and red marker may signify a distance of 100 yards from the green; a white plate and a white marker may signify a distance of 150 yards from the green; a blue plate and blue marker may signify a distance of 200 yards from the green; and a yellow plate and yellow marker may signify a distance of 250 yards from the green.

The marker extends upwardly several inches above the level of shortly cropped fairway grass which may be easily seen by golfers from distances of 50 yards or more. After a golfer has spotted one of these markers he or she can quickly estimate the distance from the ball to the green. Color coding of the markers makes it easier for a golfer to readily determine the distance from the green. The distance from the green is preferably also printed or painted on each plate. Because the color of the markers and plates is standardized for the entire golf course, a golfer can readily determine the approximate distance from the green on any hole on the course.

The mounting plate 12 is preferably recessed into the fairway so that the upper surface of the plate is about one inch below ground level. This provides adequate room for the cylindrical marker to lie against the upper surface of the plate when the marker is impacted by a mower. Thus, the mower can pass over the plate and the marker without damage to the plate, the marker, or the blades of the mower.

The outside diameter of the cylindrical marker 14 is preferably about $\frac{5}{8}$ inch. The one inch recess between the upper surface of the plate and ground level provides sufficient area for the marker 14 to occupy when a mower passes over the plate.

Because the outer tubing of the cylindrical marker 14 is elastomeric, the marker can be forced away from a vertical position to a horizontal position (lying against the upper surface of the plate) and then the marker can spring back to its original vertical position due to the elastic nature of the tubing secured to rigid mounting peg 18. Another significant advantage of the rubber tubing is that it operates to resist cutting action of rotating mower blades which contact it during mowing operations. This feature significantly reduces the ability of a sharp blade to damage or impair the integrity of the marker system on a fairway during mowing.

The rubber tubing may be composed of natural latex rubber or similar material such as Kraton rubber. Preferably the tubing includes ultraviolet light retardant material.

Preferably a rigid or inflexible rod or insert 15 is contained within the outer cylindrical tube. The rod 15 may be composed of a light-weight material such as fiberglass or other suitable material which causes the marker to maintain a straight alignment. The rod thus prevents the rubber tubing from drooping or sagging. Preferably the rod 15 extends through the rubber tubing from the upper end to the top of the mounting peg, or to a point in close proximity to the top of the mounting peg. The fiberglass rod or shaft is inserted into the rubber tubing by first wetting the rod and the tubing with soapy water. Preferably the diameter of the rod is slightly larger than the inside diameter of the tubing so that the tubing tightly grips the rod and prevents it from freely sliding out of the tubing. The rod may be solid or hollow.

Figure 3:
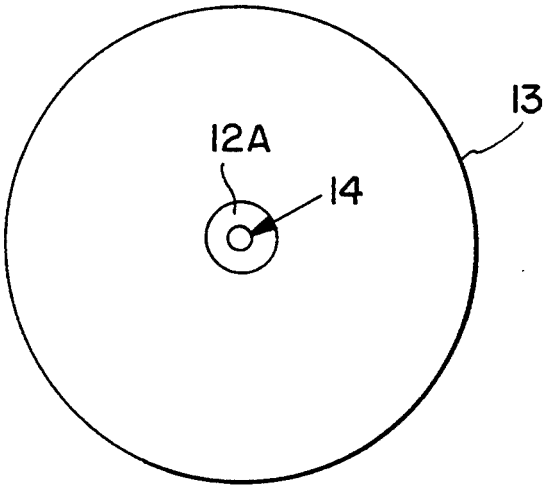
FIG. 3 is a top view of another embodiment of marker system of the invention.

The size of the plate should be sufficiently large so that the marker 14 will lie against the plate when the marker is deflected to a horizontal position. In other words, if the marker extends about six inches above the surface of the plate, then the plate should be at least about 12 inches square (or 12 inches in diameter for a round plate 13 which is shown in FIG. 3). Preferably the marker 14 is mounted at the center of the plate. The shape of the plate may vary, although square or round shapes are preferred.

The plate may be composed of any suitable rigid and durable material such as metal (e.g., steel or aluminum) or molded plastic. The upper surface of the plate should be relatively smooth and oriented in a horizontal plane when mounted in the ground.

It is preferred that the plate 12 be anchored in the ground to deter theft or vandalism. For this purpose, spikes or rods 20 secured to the underside of the plate are very useful. Preferably the spikes extend vertically downward, and the spikes may include roughened surfaces or ribs, etc. to increase friction between the spikes and the soil. The length of the spikes may vary, and the number of spikes on each plate may also vary.

Thus, the marker system of the invention is extremely effective and reliable. The cylindrical marker can be struck from any direction and it will deflect to a horizontal position against the plate, after which it will spring back to its original vertical position without damage, regardless of the ambient temperature. Repairs or replacement of markers can be very easily carried out, if necessary. There is no need to remove the anchor or plate, in order to remove one marker and slide a new marker into place on the anchor.

Other variants are possible without departing from the scope of this invention.

What is claimed is:

1. A distance marker system for mounting in a golf course fairway wherein said marker system comprises:

(a) a plate member having a central portion including a recessed cavity;

(b) an upstanding cylindrical marker member having upper and lower ends; wherein said lower end is secured in said cavity, and wherein said upper end extends above said plate member at least about six inches; wherein said marker member can be deflected in any direction away from an upstanding position to another position where said marker member lies against said plate member; and wherein said marker member is sufficiently resilient to return to said upstanding position; and (c) anchor means secured to said plate member for anchoring said plate member to the ground in said fairway.

2. A marker system in accordance with claim 1, wherein said plate member is generally square with a width of at least about 12 inches.

3. A marker system in accordance with claim 1, wherein said cavity is circular and has a diameter of about 2 inches.

4. A marker system in accordance with claim 1, wherein said marker member comprises a resilient, flexible and elastomeric rubber tubing surrounding a length of inflexible rod; wherein said rod has a length less than the length of said tubing.

5. A marker system in accordance with claim 4, further comprising an upstanding mounting peg secured in said cavity, and wherein said lower end of said tubing is frictionally attached to said mounting peg.

6. A marker system in accordance with claim 1, wherein said anchor means comprises spikes secured to said plate member and extending downwardly therefrom.

7. A marker system in accordance with claim 1, wherein said cavity includes a bottom surface having at least one drain hole therethrough.

8. A distance marker system for mounting in a golf course fairway, wherein said system comprises a plurality of markers mounted in said fairway at predetermined distances from the green; wherein each said marker comprises:

(a) a plate member having a central portion including a recessed cavity;

(b) an upstanding cylindrical marker member having upper and lower ends; wherein said lower end is secured in said cavity, and wherein said upper end extends above said plate member at least about six inches; wherein said marker member can be deflected in any direction away from an upstanding position to another position where said marker member lies against said plate member; and wherein said marker member is sufficiently resilient to return to said upstanding position; and (c) anchor means secured to said plate member for anchoring said plate member to the ground in said fairway.

9. A marker system in accordance with claim 8, wherein said markers are of distinctive colors designating defined distances from the green.

10. A marker system in accordance with claim 8, wherein each said plate member is generally square with a width of at least about 12 inches.

11. A marker system in accordance with claim 8, wherein said cavity is circular and has a diameter of about 2 inches.

12. A marker system in accordance with claim 8, wherein said marker member comprises a resilient, flexible and elastomeric rubber tubing surrounding a length of inflexible rod; wherein said rod has a length less than the length of said tubing.

13. A marker system in accordance with claim 12, further comprising an upstanding mounting peg secured in said cavity, and wherein said lower end of said tubing is frictionally attached to said mounting peg.

14. A marker system in accordance with claim 8, wherein said anchor means comprises spikes secured to said plate member and extending downwardly therefrom.

15. A marker system in accordance with claim 8, wherein said cavity includes a bottom surface having at least one drain hole therethrough.

16. A method for marking a golf course fairway to indicate a given distance from the green, the method comprising the steps of:

(a) providing a distance marker comprising:

(1) a plate member having a central portion including a recessed cavity;

(2) an upstanding cylindrical marker member having upper and lower ends; wherein said lower end is secured in said cavity, and wherein said upper end extends above said plate member at least about six inches; wherein said marker member can be deflected in any direction away from an upstanding position to another position where said marker member lies against said plate member; and wherein said marker member is sufficiently resilient to return to said upstanding position; and (3) anchor means secured to said plate member for anchoring said plate member to the ground in said fairway; and (b) recessing said plate member into the fairway at least about one inch.

* * * * *